United States Patent [19]

Weisenburger

[11] Patent Number: 4,743,208

[45] Date of Patent: May 10, 1988

[54] PIN GRID ARRAY ELECTRICAL CONNECTOR

[75] Inventor: Lawrence P. Weisenburger, Kernersville, N.C.

[73] Assignee: AMP Incorporated, Harrisburg, Pa.

[21] Appl. No.: 887,841

[22] Filed: Jul. 21, 1986

Related U.S. Application Data

[63] Continuation-in-part of Ser. No. 776,690, Sep. 19, 1985, abandoned.

[51] Int. Cl.[4] ..... H01R 4/24

[52] U.S. Cl. ..... 439/398

[58] Field of Search ..... 339/97 R, 97 P, 98, 339/99 R; 439/395–408, 443

[56] References Cited

U.S. PATENT DOCUMENTS

| | | | |
|---|---|---|---|
| 3,503,036 | 3/1970 | Desso et al. | 339/258 R |
| 3,895,852 | 7/1975 | Wasserlein, Jr. | 339/99 R |
| 4,062,610 | 12/1977 | Doty et al. | 339/75 M |
| 4,097,106 | 6/1978 | Over et al. | 339/99 R |
| 4,116,522 | 9/1978 | Reynolds | 439/398 |
| 4,141,618 | 2/1979 | Reavis et al. | 339/97 P |
| 4,159,158 | 6/1979 | Weidler | 339/97 P |
| 4,296,988 | 10/1981 | Warner | 339/97 R |
| 4,333,700 | 6/1982 | Pugh, III | 339/97 R |
| 4,335,929 | 6/1982 | Abernethy | 339/97 R |
| 4,350,404 | 9/1982 | Clark et al. | 339/99 R |
| 4,385,794 | 5/1983 | Lucius | 339/97 R |
| 4,403,821 | 9/1983 | Zimmermann, Jr. et al. | 339/97 P |
| 4,428,115 | 1/1984 | Campbell et al. | 339/99 R |
| 4,435,035 | 3/1984 | Berry et al. | 339/99 R |
| 4,527,852 | 7/1985 | Dechelette | 339/97 P |
| 4,527,857 | 7/1985 | Hughes et al. | 339/258 S |
| 4,548,459 | 10/1985 | Mosser, III | 439/443 |

FOREIGN PATENT DOCUMENTS

| | | | |
|---|---|---|---|
| 1082645 | 6/1960 | Fed. Rep. of Germany . | |
| 0016688 | 2/1977 | Japan | 339/97 R |
| 1519383 | 7/1978 | United Kingdom . | |

*Primary Examiner*—Gil Weidenfeld
*Assistant Examiner*—Gary F. Paumen
*Attorney, Agent, or Firm*—Eric J. Groen

[57] ABSTRACT

A multicontact electrical connector having individual terminals arranged in side-by-side cavities employed to interconnect a plurality of insulated conductors to terminal posts as positioned in a pin grid array. Each of the terminals includes an insulation displacement contact of the conductor at one end and a resilient contact at the opposite end formed by bifurcated members having opposed contact surfaces to engage intermediate sides of the terminal pins. Bifurcated members are twisted to define the opposed contact surfaces. The housings define open ended channels to receive a conductor inserted laterally of its axis into a slot defined in the contact terminal. Mass termination of a plurality of conductors to terminals fully inserted within the insulating housings is thus possible.

18 Claims, 8 Drawing Sheets

Fig. 8
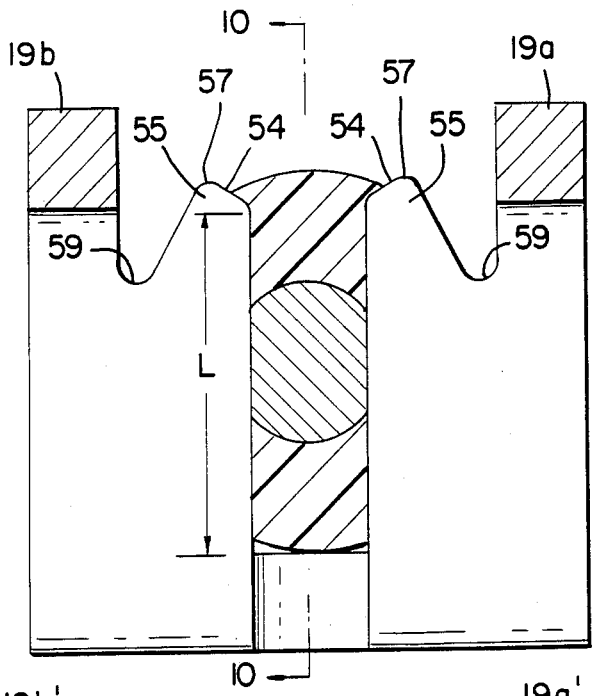
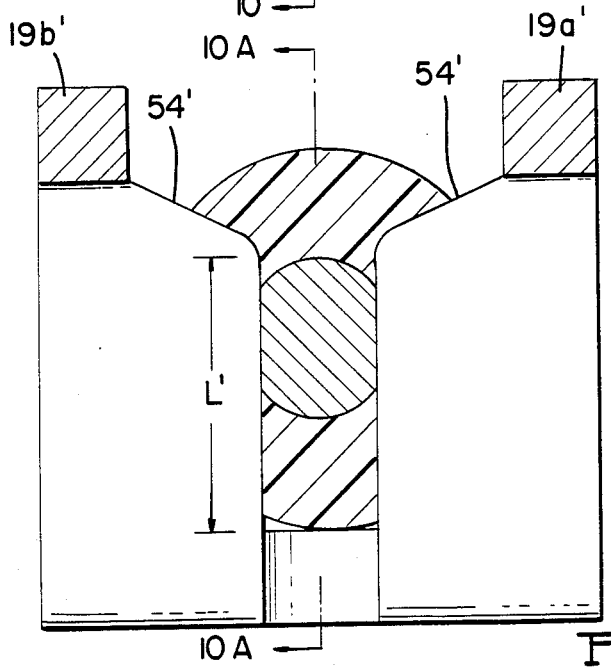
Fig. 9
PRIOR ART

PIN GRID ARRAY ELECTRICAL CONNECTOR

RELATED APPLICATIONS

This is a continuation-in-part of U.S. patent application Ser. No. 776,690, filed on Sept. 19, 1985, now abandoned.

BACKGROUND OF THE INVENTION

1. Field of the Invention

This invention relates to multicontact electrical connectors, particularly to electrical connectors for establishing an insulation displation contact with conductors, such as wires, and interconnecting the conductors to a plurality of contact elements such as pins located in one or more rows in a pin grid array.

2. Description of the Prior Art

U.S. Pat. No. 4,159,158 discloses a multicontact electrical connector using insulation displation or displacement terminals to interconnect individual wires or conductors to terminal posts on 0.100 inch centers on a printed circuit or panel board. That connector employs a plurality of individual terminals each having an insulation displacement contact section in which a wire is inserted into the contact terminal. The connector housing in which the contact terminal is positioned supports the contact terminal axially as a conductor is inserted into the insulation displacement contact section as well as supporting the insulation displation contact surface laterally. One of the principal advantages of the electrical connector disclosed in U.S. Pat. No. 4,159,158 is that conductors, such as insulated wires, can be mass terminated to a plurality of terminals in a single operation. This mass termination technique greatly simplifies interconnection of the conductors to the terminals and yields a corresponding saving in assembly costs. Although that connector does provide a low cost interconnection system suitable for use in large numbers in the electronics industry, there is an ever increasing need to reduce both the material costs and the assembly costs for interconnection systems between individual insulated conductors and contact elements such as terminal posts located on closely spaced centerlines.

The corresponding need to reduce material costs, to reduce assembly costs, and to maintain closely spaced centerlines between terminals in the multicontact connector are generally contradictory. For example, the connector depicted in U.S. Pat. No. 4,062,610 can be used to mass terminate conductors in a housing on closely spaced centerlines. However, the fabrication of the contact terminal, its plating, and the amount of material needed in the fabrication of the terminal can be relatively expensive. Similarly, the connector disclosed in U.S. Pat. No. 4,385,794, while exhibiting a number of advantages which have made this connector a highly successful interconnection system, does employ a large amount of material to fabricate the connector terminal.

Contacts of the type shown in U.S. Pat. No. 4,385,794, and of the type involved in the instant invention are arranged in dense arrays of closely spaced terminals typically having centerline spacings of 0.100 inches between adjacent terminals. The wire used on this type spacing is typically 22–28 guage with the diameter of the insulation approximately 0.050 inches. Therefore, the formed width of the contacts must, per se, be greater than 0.050 inches but less than 0.100 inches. Contacts of this size are typically left on the carrier strip after being stamped and formed as the contacts are easier to handle while connected to the carrier strip. Once all contacts are inserted into the respective cavities, the carrier strip may be cut off leaving all contacts in place within the connector. In order to simplify the manufacturing and assembling costs involved, it is preferable to have a contact which, in the flat blank stage, is also less than the centerline spacing of the connector cavities, in this case, less than 0.100 inches. If this design is achieved, all of the contacts can be loaded within the housing cavities from a single carrier strip. If the width of the contact, in the flat blank stage, is greater than the centerline spacing of the connector cavities, the contacts could not be loaded into the connector cavities from a single carrier strip, because the centerline spacings of the formed contacts could not possibly be on the centerline spacing of the connector cavities.

Referring again to the contact disclosed in U.S. Pat. No. 4,385,794, and more specifically to his FIG. 1, it is apparent from the box type receptacle portion 16, that the unfolded width of the flat stamping is wider than the centerline spacing of the contacts. Therefore, the installation of the contacts is made more difficult as more than one carrier strip is required to load all contacts within the housing. Although a connector of the type shown in U.S. Pat. No. 4,435,035 can be employed with a mass termination technique in which conductors are inserted into the insulation displacement terminals while the terminals are fully inserted into the housing, centerline spacing for which this operation can be accomplished may be limited, and this connector does employ a large amount of material to form the terminal.

A connector having an insulation displacement slot formed by stamped metal forming two upstanding plates interconnected by a bight portion is shown in U.S. Pat. No. 4,335,929. Although this connector does allow close centerline spacing between adjacent terminals in the same connector, the terminals U-portion in U.S. Pat. No. 4,335,929 is relatively high as the wire terminating slot must be long enough to accommodate a conductor and allow good electrical connection, and a terminal of this height does not allow lateral stacking with adjacent connectors and maintain 0.100 inches lateral spacing between centers.

A terminal is disclosed in U.S. Pat. No. 4,527,857 which utilizes an insulation displacement slot at one end and folded arms at the opposite end to contact blade type terminals. However, this contact could not be used to contact posts on a square matrix.

As shown in FIG. 1, the contact has two pairs of parallel and opposed contacts for contacting a blade terminal. As blade terminals are longer than 0.100 inches, the terminals shown in U.S. Pat. No. 4,527,857 could not be utilized for a 0.100 square matrix.

The connector disclosed herein not only achieves the excellent performance exhibited by these former interconnection systems but also offers even lower cost interconnection system by significantly reducing the amount of material which must be used to fabricate the contact terminal, by facilitating plating on only a single surface of the stamped terminal blank, and by providing an insulating housing which can be positioned side by side and end to end with similar contact housing assemblies to form an interconnection system between contact elements, such as terminal posts located on closely spaced centers in a multidimensional array.

SUMMARY OF THE INVENTION

An electrical connector assembly for establishing an insulation displacement contact between a plurality of insulated conductors and a fixed array of closely spaced contact elements, such as terminal posts or pins located in an array of pins on a 0.100 inch square matrix. The connector includes an insulative housing and a plurality of individual terminals stamped and formed and then positioned within cavities extending at least partially through the insulative housing, and each terminal has a spring contact portion engagable with the terminal posts and a separate insulation displation section for use in establishing contact with the individual conductors, such as insulated wires. The insulation displation section comprises a U-shaped member defined by two upstanding plate members and a continuous bight portion therebetween. The slot is stamped into the U-shaped member at a direction which is transverse to the plane of the plates. Finger portions which lie in the plane of the plate portions but separated from the strap portions forming the bight portion are disposed adjacent to the slot in the plates and have edges aligned with the edges of the slot in the plates, effectively increasing the slot length without increasing the overall envelope of the terminal. The pin contact section of the terminal is formed by two bifurcated members also extending generally axially. These bifurcated members are formed upwardly and are twisted such that contact surfaces formed on each bifurcated member are inwardly facing and in opposed relationship, in a position to engage terminal posts on sides between adjacent terminal posts. The width of the terminals and the bifurcated pin contact section is no greater than the width of the contact terminals in the insulation displation section. Furthermore, the width of the flat stamped blank is no wider than the width of the formed terminal. Both the insulation displation section and the pin engaging section are formed upwardly from the base of the terminal to permit a conductor to be inserted laterally of its axis into the wire engaging slot while the terminal is fully positioned within the insulative housing and, furthermore, to permit the bifurcated members forming the pin engaging section to engage pins centrally positioned within the housing.

BRIEF DESCRIPTION OF THE DRAWINGS

FIG. 8 is a cross-sectional view through the bight portion of the terminal.

FIG. 9 is a cross-sectional view through the bight portion of a representative prior art terminal.

DETAILED DESCRIPTION OF THE PREFERRED EMBODIMENT

The preferred embodiment depicted herein comprises a multicontact electrical connector having a plurality of terminals forming an interconnection between individual conductors, such as insulated wires, and contact elements, such as terminal posts, positioned in a closely spaced array. For example, this closely spaced array of contact elements or terminal posts can be positioned in a square matrix in which adjacent pins in each row and column are spaced apart by a distance on the order of 0.100 inches. It should also be understood that the instant invention can also be employed for interconnecting conductors to posts having centerline spacings greater than or less than this standard centerline spacing. Furthermore, the connector assembly depicted herein can be employed for use in terminating bare conductors or can be used for terminating flat conductors included in a multiconductor flat cable, or can be used to terminate round conductors in a ribbon cable. This invention is not limited to use in terminating individual insulated round wires to the terminal post. Furthermore, this invention is especially adaptable for use in electrical connectors in which a varying number of conductors can be employed. For instance, this invention is amenable to use with a single position electrical connector and is also suitable for use in a connector having many more positions than the six-position connector depicted herein.

Figure 1:
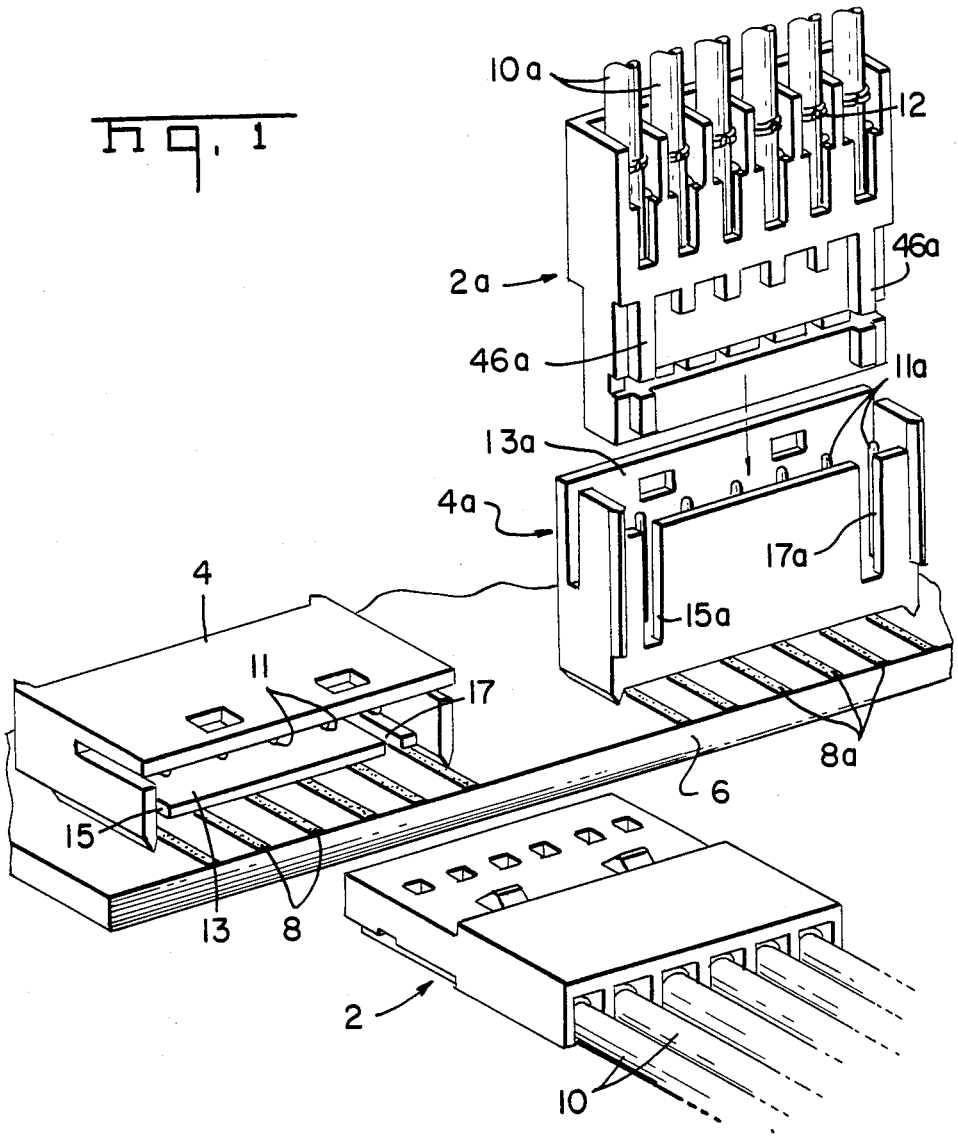
FIG. 1 is a perspective view of vertical and horizontal mounted pin grid array connectors, positioned for insertion into vertical and horizontal pin headers.

As shown in FIG. 1, the connector assembly comprises a plug member 2 containing a plurality of terminals 12 for use in establishing electrical contact with contact elements such as terminal posts 11, shown here in a pin header 4. FIG. 1 discloses two plug connectors 2 and **2*a*, both of which are identical. FIG. 1 also demonstrates that the same plug header can be used for interconnecting terminal posts 11 extending horizontally relative to the surface of a printed circuit board 6, or the same connector, here shown as connector 2*a*, can be used to establish an interconnection with posts 11*a* extending vertically relative to the printed circuit board 6. Although this invention is adaptable for use with free standing contact elements or terminal posts 11 or 11*a*, it is especially adapted for use in conjunction with a pin header, such as the horizontal pin header 4 and the vertical pin header 4*a* shown in FIG. 1. Thus the connector assembly depicted in FIG. 1 comprises a means for interconnecting a plurality of conductors, such as insulated round wire conductors 10 and 10***a*, to a plurality of terminal posts 11 and 11*a* which in turn can be used to interconnect the conductors to conductive paths 8 and 8*a* located on the surface of a printed circuit board 6.

Figure 4:
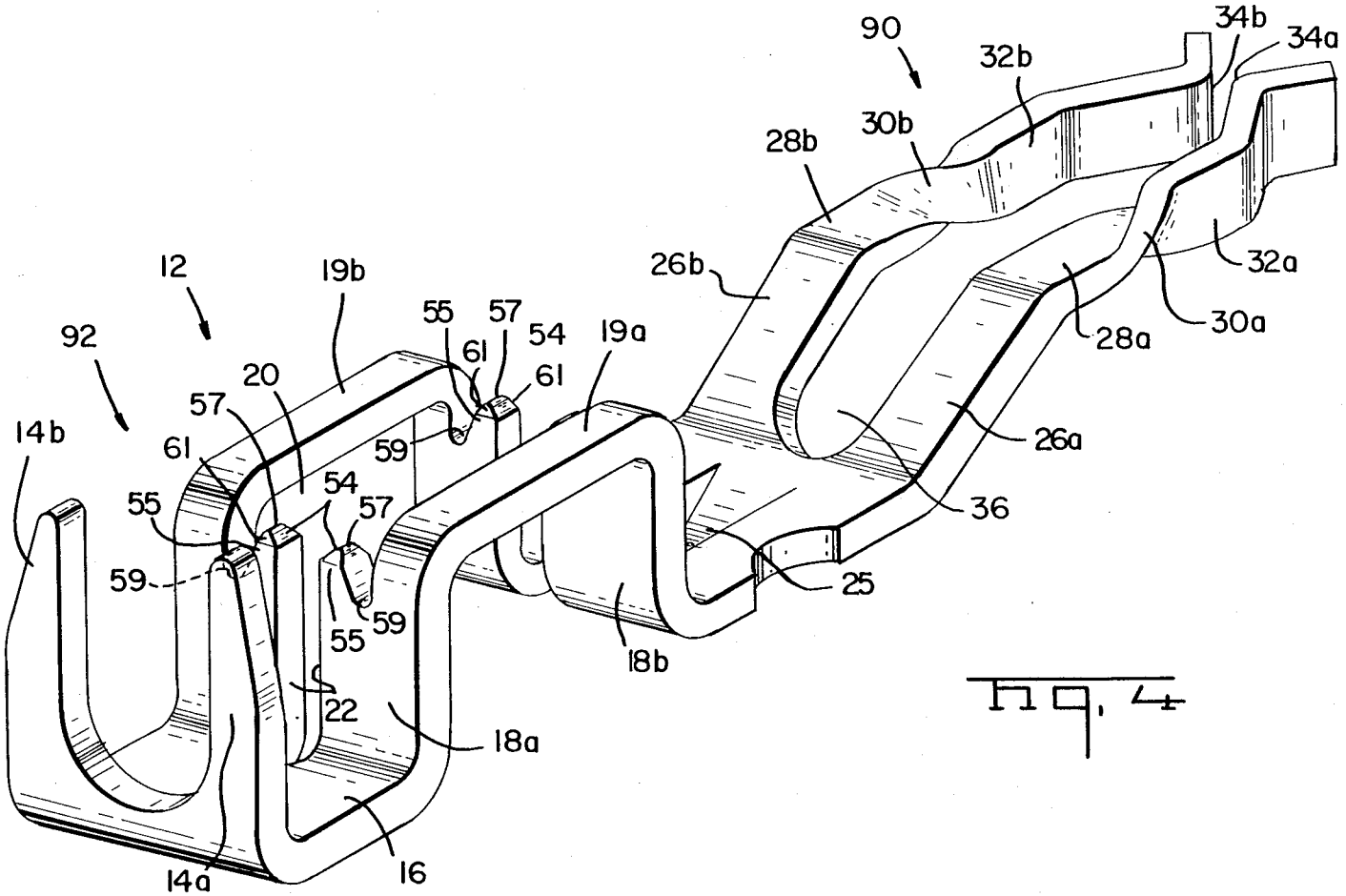
FIG. 4 is a perspective view of a single terminal in accordance with the preferred embodiment of this invention.
Figure 12:
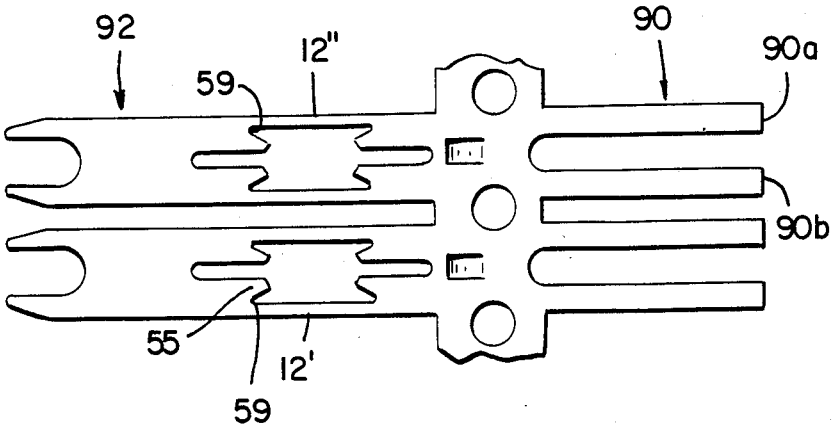
FIG. 12 is a view of a stamped blank in accordance with the preferred embodiment.

The terminal 12 comprising the preferred embodiment of this invention is depicted in FIG. 4, and comprises a stamped and formed electrical terminal having an insulation displation section 92 and a contact or pin-engaging section 90. In the preferred embodiment of this invention, the contact terminals are stamped from a blank having a width less than the spacing between adjacent pins for which the interconnection is to be made. The width of the contact terminal blank, as shown in FIG. 12 is essentially constant along the length of the terminal and the width of the contact or pin element engaging section 90 is no greater than the width of the insulation displation section 92. Furthermore, the width of the flat stamping (FIG. 12) is no wider than the formed terminal (FIG. 4). It can be appreciated from FIG. 2, FIG. 4, and FIG. 12 that the width of the insulation displation section 92 and the contact or pin-engaging section 90 in the stamped and formed blank must be less than the spacing between adjacent pin-engaging elements. The width of the contact terminals is also less than the centerline spacing between adjacent cavities and channels in the insulative housing.

The contact terminal 12 is stamped from a spring metal, such as brass. Conventional platings such as tin lead plating or gold plating are typically applied to the terminal to present a mill finish surface to the mating pin. As will be apparent from a discussion of the configuration of the terminal, the terminal 12 can be plated, in the vicinity of the contact surfaces which engage the contact elements or pins, by merely selectively plating only one surface of the stamped contact before the contact is formed to its final configuration or by plating only a portion of the stamped metal blank. This ability to selectively plate only one surface can significantly reduce the cost of expensive plating, such as gold.

Figure 3:
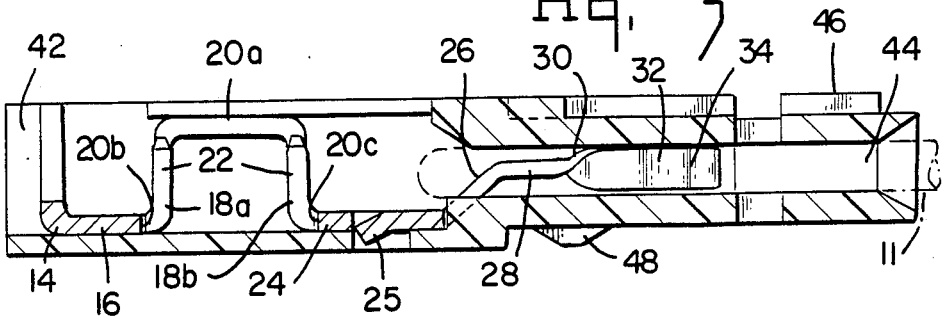
FIG. 3 is a sectional view taken along section 3—3 of FIG. 2, showing a sectional view of an individual terminal mounted in the housing.

As shown in FIG. 4, the insulation displacement section 92 of the contact terminal 12 shown in FIG. 4 comprises an axially extending wire-receiving slot 20 intermediate the ends of the terminal and adjacent a wire retention portion comprising tangs 14*a* and 14*b* located on one end of the terminal. The tangs 14*a* and 14*b* are formed by removing material in the center of the stamped blank and forming the tang portions 14*a* and 14*b* upwardly so that they extend generally perpendicular to a flat portion 16 originally in the plane of the stamped member. The wire receiving or wire displacement slot 20 comprises a means for forming an electrical contact to an insulated conductor upon movement of the insulative conductor laterally of its axis and includes conductor contacting edges 22, which are formed in two upstanding plate members 18*a* and 18*b* connected by an intermediate bight portion comprising sections 19*a* and 19*b*. As shown in FIG. 3, the wire receiving slot 20 comprises a first section 20*b* in plate section 18*a*, a second section 20*a* between segments 19*a* and 19*b* and a third slot segment 20*c* extending into plate section 18*b*. The ends of each slot 20 extend into a portion of the flat section 16 which is in the original plane of the stamped blank and into a central section 24, also in the original plane of the flat blank. Thus the length of the slot is greater than the height of the plate segments 18*a* and 18*b*. A portion of the slot 20*a* and the bight segments formed by 19*a* and 19*b* is generally wider than the conductor 50 forming the core of the insulated conductor.

Figure 10:
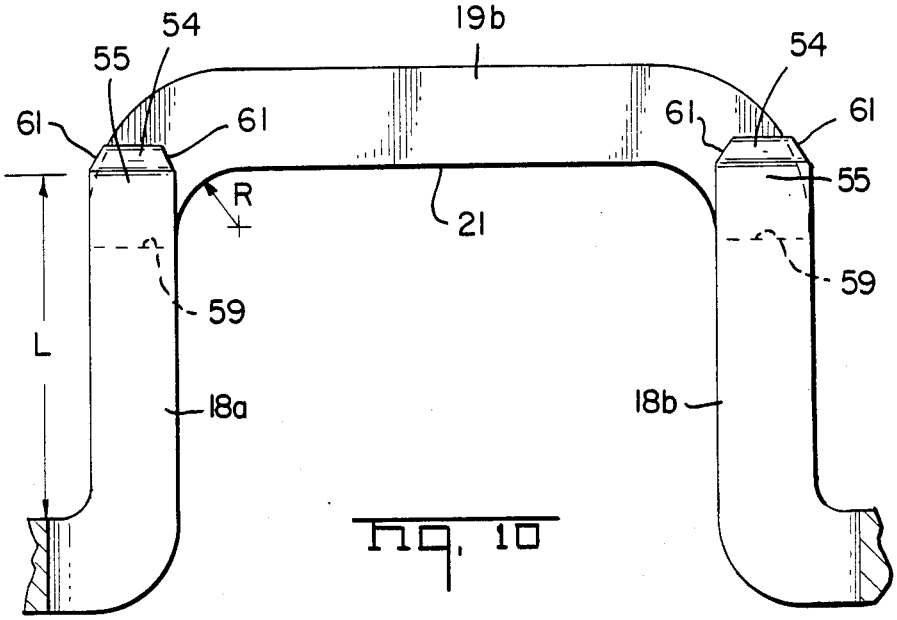
FIG. 10 is an enlarged view of the insulation displacement portion shown in FIG. 3.
Figure 10A:
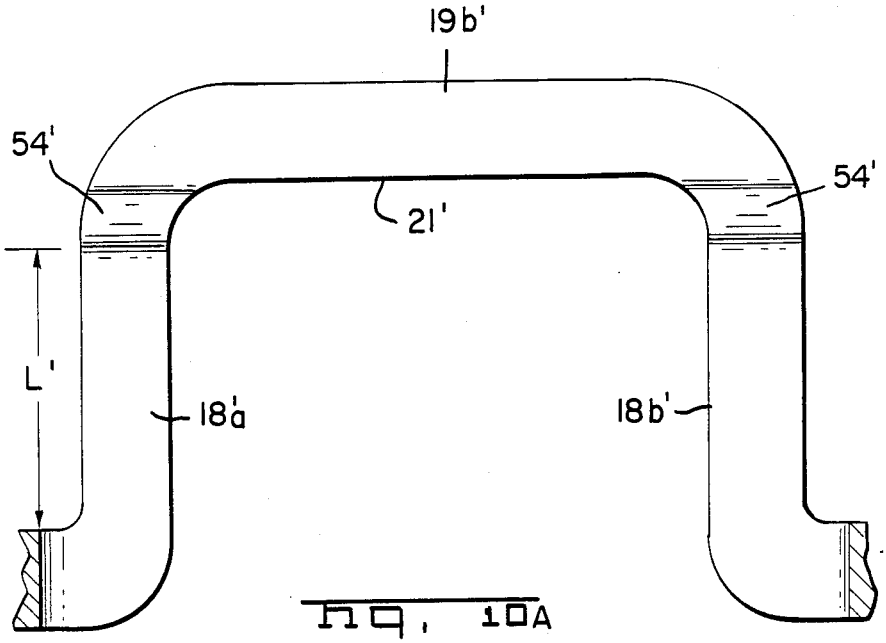
Fig. 10A PRIOR ART
FIG. 10A is a cross-sectional view through the lines 10A—10A of FIG. 9.

A cross-sectional view of an insulation displacement portion of a prior art terminal is shown in FIG. 9 with an effective slot length of L'. An insulation displacement slot should only lie in the plane of the plate portions, or in the plane of plates 18*a*', 18*b*', of FIG. 10A, and not into the radiused section. In forming a terminal as shown in FIG. 10A, the minimum radius R which can be formed is limited to the diameter of the material thickness, thereby precluding any surface cracking at the outer surface of the radiused portion. Furthermore, the insulation displacement slot requires a lead-in portion such as 54', as shown in FIG. 9 to assist in shearing the insulation exposing the conductor in order to terminate the conductor within the insulation displacement slot. In light of the above considerations, minimum radius and required lead-in portion, the effective or usable contacting portion of an insulation displacement slot is thereby reduced. As shown in FIG. 10A, the usable contacting portion of the prior art slot is reduced to L', which is well below the underside surface 21 of portions 19*a*, 19*b*.

However, in the instant invention, the insulation displacement portion 92 further includes finger portions 55 extending contiguously with the plate portions 18*a*, 18*b* and upstanding in the same plane as the plate portions 18*a*, 18*b*. As best shown in FIG. 10, as the strap portions which form the bight portions 19*a*, 19*b* are bent relative to the plate portions 18*a*, 18*b* and relative to the finger portions 55, the radius R does not affect the usable portion of the slot. Without increasing the overall height of the terminal itself, the usable portion of the slot is now be increased to L, which is well above the underside surface 21 of the portions 19*a*, 19*b*. The insulation displacement slot can still include a lead-in portion 54 without substantially reducing the usable contacting portion of the slot.

Figure 11:
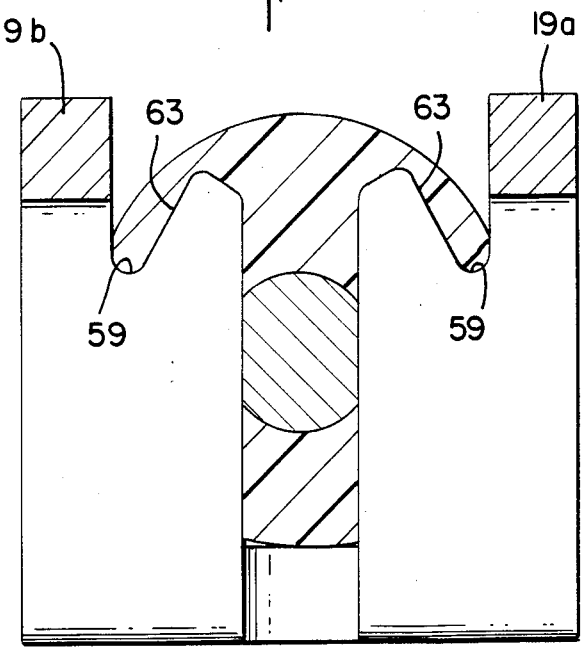
FIG. 11 is similar to that of FIG. 8 showing a wire terminated having thick insulation.

The extension portions 55 further include radiused portions 57 which first contact the insulation upon insertion of the wire into the slot 20, thereby assisting in initially piercing through the insulation. The extension portions 55 also include beveled surfaces 61 (FIG. 10) which further assist in piercing through the insulation. If a wire is terminated having a large amount of insulation, as shown in FIG. 11, the insulation fills in radiused portion and produces a normal force on surface 63, thereby increasing the force between the plate edges 22 and the conductor, thereby increasing the integrity of the electrical connection.

Figure 6:
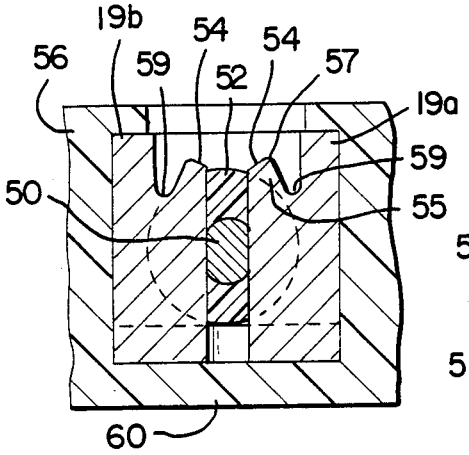
FIG. 6 is a sectional view through lines 6—6 of FIG. 5A showing an insulation displacement contact with an insulated wire.

The engagement of the slot edges 22 with the conductor is shown most clearly in FIG. 6. Since the ends of the slots 20*b* and 20*c* extend not only through the plate-like segments 18*a* and 18*b* but into the flat segments 16 and 24 (FIG. 3), the conductor 50 can be inserted into slots 20*b* and 20*c* to a point in which the insulation 52 engages the base segments of the terminal. Thus the insulation displacement portion of the preferred embodiment of the terminal disclosed herein comprises a low profile member suitable for use with closely spaced connector housings. Furthermore, the extension of the slot into the base portion 16 and 24 serves to increase the elastic deflection which can be achieved with this connector configuration, thus permitting the terminal to be used with wires having different diameters or different gauges.

The central base portion 24 of contact terminal has a lance 25 deflected laterally outward from the plane of the central portion 24, which remains in the original plane of the stamped blank when the terminal configuration is formed. The central base section 24 is positioned intermediate the insulation displation portion 92 located on the conductor engaging end of the terminal and the rear or mating end of the terminal 90. This rear or mating end of the terminal 90 comprises a contact element or pin engaging section and consists of bifurcated members having inclined sections 26*a* and 26*b* and arms on which opposed contact surfaces 34*a* and 34*b* are defined. Each of these bifurcated members is defined by an axially extending second slot 36 generally in alignment with slot 20. The cantilever arms and the contact surfaces 34*a* and 34*b* defined thereon are positioned intermediate the height of the contact terminal. The inclined surfaces 26*a* and 26*b* are formed during the contact fabrication operation such that opposed contact surfaces 34*a* and 34*b* are centrally disposed relative to the slots 20 and are positioned such that contact surfaces 34*a* and 34*b* can engage the sides of contact pins. As shown most clearly in FIG. 4, the cantilever arms consist of a first segment 28*a* and 28*b* which is generally parallel and spaced from the base 24. A twist 30*a* and 30*b* is formed intermediate the ends of the cantilever arms such that second sections 32*a* and 32*b* extend generally perpendicular to the intermediate section 24 and perpendicular to the original plane of the stamped blank from which the terminal is formed. The contact surfaces 34*a* and 34*b* are formed in these transverse or perpendicularly extending sections of the cantilever arms and are radiused such that the contact surfaces 34*a* and 34*b* are more closely spaced in opposing relationship than the remaining sections of the bifurcated members. The bifurcated members thus form a resilient contact with the terminal pins upon insertion of the terminal pins in between the contact surfaces 34*a* and 34*b*. Bifurcated members 34*a* and 34*b* flex generally about the root of the second slot stamped and defined to the two bifurcated members.

The contact surfaces 34*a* and 34*b* which are laterally opposed when the contact terminal is stamped are initially formed on the same surface of the contact terminal. Thus if the stamped terminal or the blank is plated on one surface in the vicinity of the contact surfaces 34*a* and 34*b*, both opposed surfaces 34*a* and 34*b* will be plated when the terminal is subsequently formed in the manner shown in FIG. 4.

Figure 2:
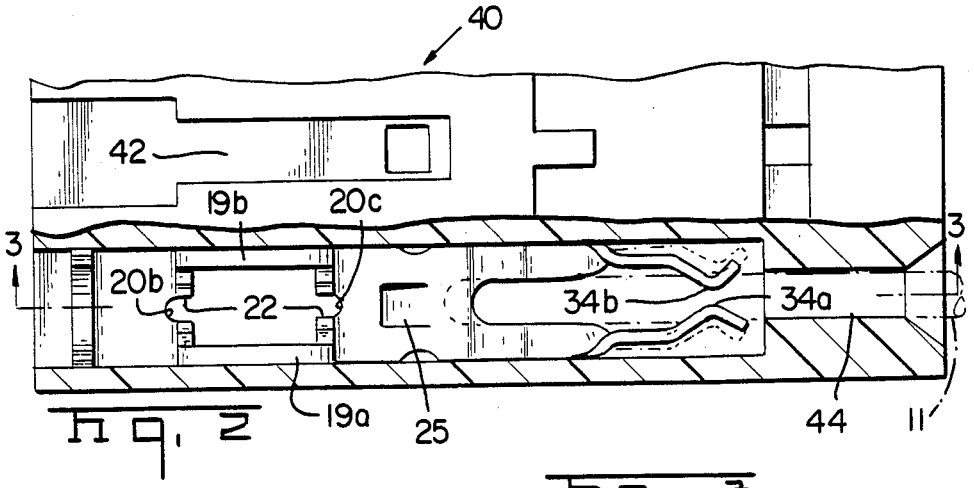
FIG. 2 is a plan view, partially in section, of the preferred embodiment of this invention showing a single terminal inserted into the insulative housing.

As shown in FIG. 2 and in FIG. 3, the contact terminal 12 can be inserted into a cavity formed between opposite ends of a multicontact insulating connector housing 40. These cavities which extend from end to end in the housing 40 consist of a first channel 42 which is open on one face and an enclosed cavity 44 merging with and axially aligned with each channel 42. The enclosed cavities 44 are dimensioned to receive the contact element or pin-engaging section 90 of the corresponding contact terminals, while the open-faced channels 42 are adapted to receive the insulation displation section 92 of the terminal 12. The flange 25 and the intermediate base portion 24 of the terminal is received within a recess in the insulative housing to engage the shoulder which prevents the terminal from being removed after insertion. The insulation displacement conductor engaging portion of the terminal and its slot 20 are located in the channel 42, each channel being defined by two opposed sidewalls and a base. Thus the slot 20 is exposed for subsequent insertion of a conductor laterally of its axis and laterally of the axis of the channel 42 into the slot 20. The portion of the channel 42 adjacent the furthermost end of the housing is wider than the remaining portion of this housing. The wire retention tangs 14*a* and 14*b* are positioned in this wider section of the housing as is apparent in FIG. 2. The coaxial closed end cavity 44 has a height which is less than the height of the channel 42, as can be seen in FIG. 3. The mating end of the insulating housing in which the closed-in cavity 44 is defined is generally thinner than the conductor engaging end of the housing in which the insulation displation portion of the terminal is located. This thinner mating section thus provides room for an elongate ridge 46 defined along a portion of the mating end of the housing and having a thickness no greater than the thickness of the conductor engaging section, as can be seen quite clearly in FIG. 3. Furthermore, a retention tab 48 can be defined on the surface of the mating end of the housing opposite from the position of ridge 46. By providing a thinner mating section, the retention member 48 and the keying ridge 46 can both be integrally defined on the exterior of the housing and the total thickness of the housing will not be increased by virtue of the presence of the retention tab 48 and the keying ridge 46.

Figure 7:
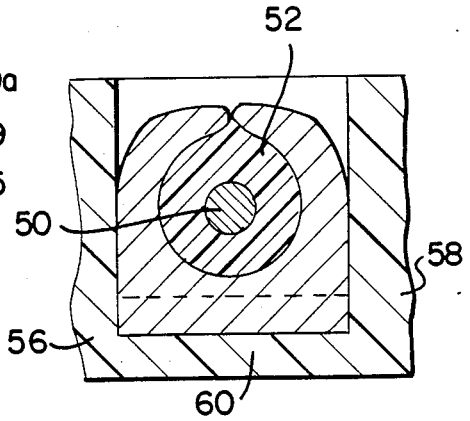
FIG. 7 is a sectional view through lines 7—7 of FIG. 5A of the crimped strain relief established by the terminal comprising the preferred embodiment of this invention.
Figure 5:
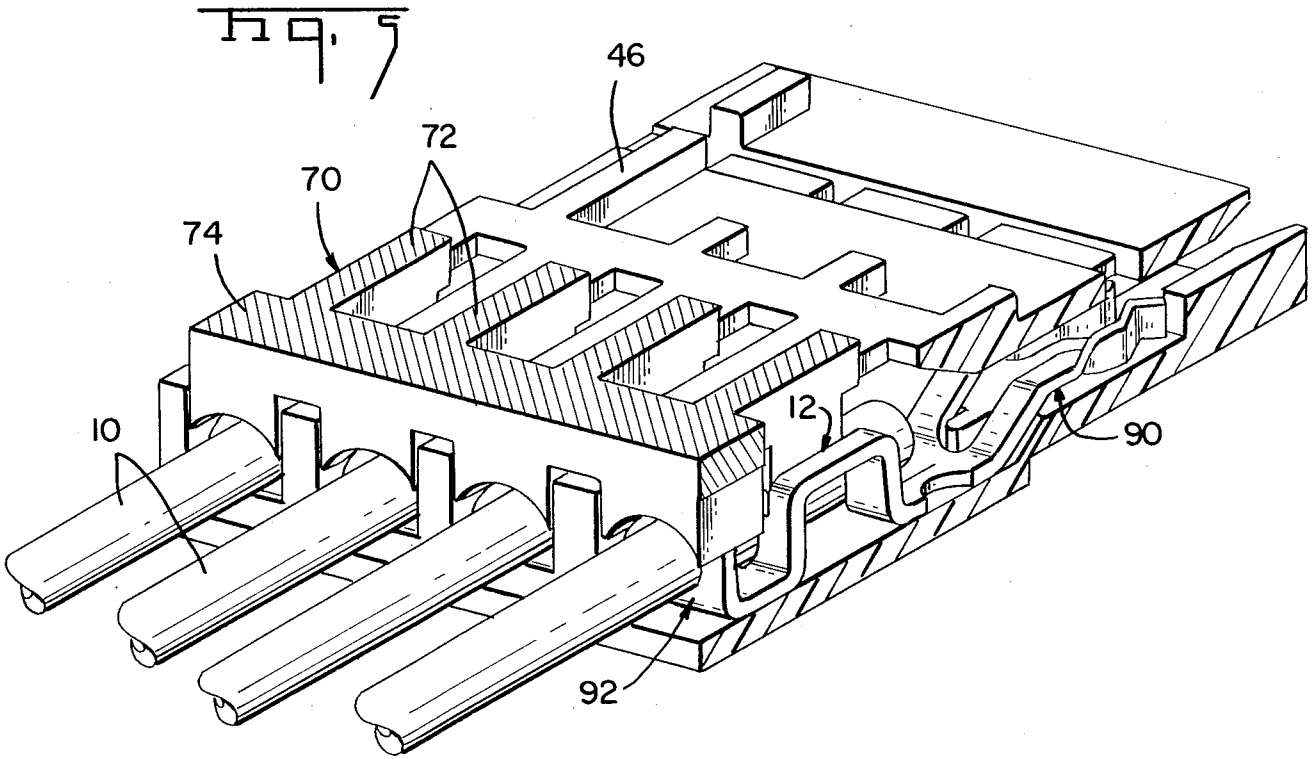
FIG. 5 is a perspective view, partially in the section, showing the mass termination of a plurality of round conductors in a multicontact terminal in accordance with the preferred embodiment of this invention.
Figure 5A:
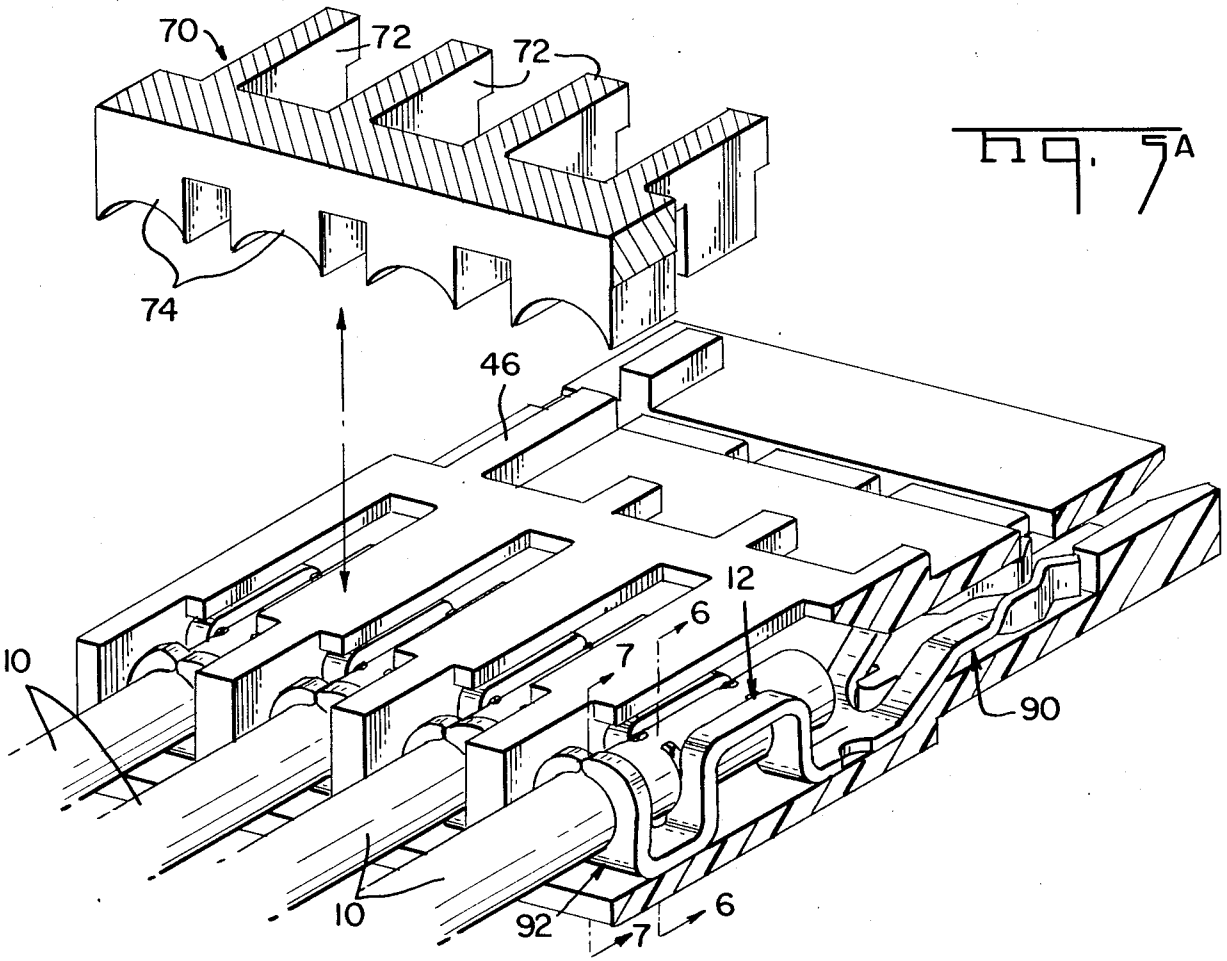
FIG. 5A is a view similar to FIG. 5 showing the withdrawal of the insertion apparatus and showing the conductors attached to terminals in the multicontact electrical connector comprising the preferred embodiment of this invention.

FIGS. 5 and 5A demonstrate the manner in which a plurality of insulated conductors can be mass terminated in the terminal 12. As shown in FIG. 5, a multiposition inserter member 70 comprising a crimping section 74 and an insulation displacement insertion section 92 can be positioned in registry with the insulation displacement portions of the terminals in the housing of connector 2. The crimping section 74 can be positioned in alignment with the retention tabs 14*a* and 14*b* of the terminal while the inserter member 72 can be positioned in registry with the slots 20 defined in the terminals 12. Thus upon movement of the inserter towards the terminals, and subsequent movement of the conductors laterally of their axis and into the channels, a plurality of conductors 10 can be simultaneously mass terminated to insulation displacement slots 20 in individual aligned terminals 12. Furthermore, the retention tabs 14*a* and 14*b* can be crimped around the exterior of the conductor, as shown in FIG. 7, to retain the conductors in electrical contact with slot 20. FIG. 5A illustrates the insulation displacement contact formed by each terminal on the corresponding conductor 10. Note that the conductors are terminated with the terminals fully inserted into the insulated housing, thus precluding the additional step of fully inserting the terminals after wire termination. Note that the wider portion of the channel 42 adjacent the free end of the insulative housing provides clearance into which the crimping section of the inserter 70 can enter to deform barbs 14*a* and 14*b* about the conductor.

After the conductors have been terminated to their respective terminals in the manner shown in FIGS. 5 and 5A, the individual plug connector 2 can be inserted into a pin header housing 4 or 4*a* in the manner shown in FIG. 1. Note that the horizontal pin header 4 and the vertical pin header 4*a* each define a compartment 13 and 13*a* respectively into which the pins 11 and 11*a* respectively extend. Slots 15 and 17 are formed into one wall of the pin header 4. Similarly slots 15*a* and 17*a* are also formed into a wall of the vertical pin header 4*a*. These slots 15 and 17 and 15*a* and 17*a* respectively are dimensioned to receive the keying ridges 46 located on one surface of the plug connector housing 40. In the preferred embodiment of this invention, a plurality of ribs 40 could be arbitrarily positioned on one surface of the connector housing, thus ensuring that only a mating plug and receptacle housing could be mated, assuring that appropriate conductors are interconnected to appropriate contact elements or pins 11. Note that in the embodiment shown in FIG. 1 each of the receptacles has two ridges 46 and each of the pin header receptacle housings have two grooves 15*a* and 17*a* to serve as keying means.

The preferred embodiment of this invention is especially adapted to allow a mass termination interconnection between a plurality of conductors and closely spaced terminal pins in a pin grid array on a 0.100 inch centerline square matrix. The opposed contact surfaces 34*a* and 34*b* are twisted intermediate their length allowing resilient contact with very little material, further allowing close spacing between adjacent contacts. As the finger portions 55 effectively extend the slot length without raising the height of the terminal, the connectors can be stacked laterally side-to-side on a 0.100 inch centerline.

As the flat blank stamping is no wider than the centerline spacing of the contacts and no wider than the formed terminal, the contact is very efficient with respect to the quantity of material used. Previous prior art terminals used twice as much material to accomplish the same objective.

In addition to using less material providing a substantial cost savings, the design of the flat blank having contacts narrower than the centerline spacing between the contacts allows all of the contacts to remain on one carrier strip after they are formed with a centerline spacing of 0.100 inches. This design provides for an easier and a more efficient assembly operation in that only one carrier strip must be handled by an automatic assembly machine which inserts the contacts into the housing. On previous prior art contact designs the flat stamping of the contact was wider than the centerline spacing between the contacts, requiring a plurality of carrier strips being handled by the automatic assembly machine. An automatic assembly machine for installing two carrier strips is more complex and costly than the automatic assembly machine which inserts one carrier strip, as the contacts must be stamped on 0.200 inch centerlines and then overlapped to give a centerline spacing of 0.100 inches.

The connector design also allows mass termination of all wires with the contacts fully loaded. As the connector housing is designed with apertures exposing the insulation displacement portions, the individual wires of multiconductor cable or ribbon cable can be mass inserted with the contacts fully loaded as shown in FIGS. 5 and 5A.

I claim:

1. An electrical connector for interconnecting electrical signals, the connector comprising:

a housing having terminal receiving cavities therein; and a plurality of terminals, disposed in said cavities, having an insulation displacement portion comprising plate means having a contiguous radiused portion, said plate means including a slot profiled to terminate a conductor of an insulated wire and finger portions separated from said radiused portion thereby defining free ends which lie substantially in the plane of said plate means, adjacent to the radiused portion and flanking the conductor receiving slot, the finger portions having edges aligned with, and colinear with, edges of the conductor receiving slot, whereby the finger portions effectively increase the slot length without increasing the height of said terminal.

2. The connector of claim 1 wherein the electrical terminals further comprise a normal force contact portion.

3. The connector of claim 2 wherein the normal force contact portion comprises two elongate arms radially twisted about an axial center line of said arms to dispose surfaces of the same plane in opposed relationship with one another.

4. The connector of claim 1 wherein the plate means comprise first and second substantially parallel plates having a bight portion therebetween.

5. The connector of claim 4 wherein the bight portion comprises an opening stamped therein profiled for receiving laterally thereof an insulated wire.

6. The connector of claim 5 wherein the opening in said bight portion defines two strap portion connected to said parallel plates.

7. The connector of claim 5 wherein the wire receiving opening is continuous with the conductor receiving slots.

8. The connector of claim 1 wherein the finger portions are beveled inwardly to progressively receive insulation of a wire.

9. The connector of claim 1 wherein the finger portions comprise means for severing insulation of a wire to be terminated.

10. The connector of claim 9 wherein the severing means comprises pointed sections on said finger portions.

11. The connector of claim 1 further comprising a relief area disposed between said finger portions and said radiused portion for receiving insulation of an insulated wire.

12. The connector of claim 4 wherein a first longitudinal portion extends from said first plate, and a second longitudinal portion extends from said second plate and the conductor receiving slots extend downwardly through the plate portions and partially into the longitudinal sections.

13. The connector of claim 12 wherein the second longitudinal portion connects the insulation displacement portion with a normal force contact portion.

14. The connector of claim 12 further comprising tang portions extending from said first longitudinal portion profiled to wrap around a wire for strain relief.

15. The connector of claim 1 wherein the housing cavities include a base and sidewalls upstanding thereof, and a top wall at least partially enclosing said cavity.

16. The connector of claim 15 wherein the terminals are profiled to fit within the housing cavities, the width of the terminals profiled to fit between the sidewalls and the insulation displacement portions profiled to fit below the top wall.

17. The connector of claim 16 wherein the top wall is profiled to expose the opening in said bight portion allowing mass termination of the wires to the insulation displacement portion while the terminals are fully inserted within the housing.

18. An electrical connector for interconnection to an array of pins, the connector comprising:

a housing having terminal receiving cavities therein, the cavities including a base and sidewalls upstanding thereof and a top wall at least partially enclosing said cavity; and a plurality of terminals disposed in said cavity, the terminals being stamped and formed to define a first flat portion lying adjacent to the base, then extending upwardly to define a first flat plate, and extending downwardly to define a second flat plate with a bight portion between said flat plates, the flat plates and the bight portion being continuous through radiused portions, the bight portion having an opening stamped to extend longitudinally of said terminal and profiled to receive laterally thereof an insulated wire, the opening in said bight portion defining two strap portions interconnecting said plates, the first and second plates having slots contiguous with said wire receiving opening extending downwardly towards said base, the slots in said plates profiled to terminate a conductor of said insulated wire, the plates including finger portions separated from said strap portions to define free ends, the finger portions lying closely adjacent to the radiused portions and flanking the conductor receiving slots, the finger portions having edges colinear with edges of the slots, a second flat portion extending from said second flat plate lying adjacent to said base, two arms extending from said second flat portion formed upwards orthogonally to the base then flattened to lie substantially parallel to said base, the arms then twisted to dispose surfaces initially in the same plane into parallel and opposed relationship with one another.

* * * * *

UNITED STATES PATENT AND TRADEMARK OFFICE

CERTIFICATE OF CORRECTION

PATENT NO. : 4,743,208

DATED : May 10, 1988

INVENTOR(S) : Lawrence P. Weisenburger

It is certified that error appears in the above-identified patent and that said Letters Patent is hereby corrected as shown below:

In claim 18, line 24; (column 12, line 3), after "from" insert --, and discontinuous with,--.

Signed and Sealed this

Tenth Day of January, 1989

*Attest:*

DONALD J. QUIGG

*Attesting Officer*

*Commissioner of Patents and Trademarks*